US008844110B2

(12) United States Patent
Rotter

(10) Patent No.: US 8,844,110 B2
(45) Date of Patent: Sep. 30, 2014

(54) INDEPENDENT SELF-CLOSE MECHANISM FOR PULLOUT DRAWER

(75) Inventor: Chad J. Rotter, Amana, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/608,186

(22) Filed: Sep. 10, 2012

(65) Prior Publication Data

US 2013/0055543 A1 Mar. 7, 2013

Related U.S. Application Data

(62) Division of application No. 12/560,477, filed on Sep. 16, 2009, now Pat. No. 8,282,177.

(51) Int. Cl.

| | |
|---|---|
| ***B23P 11/00*** | (2006.01) |
| ***A47B 96/16*** | (2006.01) |
| ***F25D 25/02*** | (2006.01) |
| ***A47B 88/04*** | (2006.01) |

(52) U.S. Cl.

CPC ..... *A47B 88/047* (2013.01); *F25D 25/025* (2013.01)

USPC ..... 29/434; 29/525.01; 29/525.02; 312/402; 312/333; 312/319.1

(58) Field of Classification Search

USPC ..... 29/434, 525.01, 525.02; 312/402, 333, 312/319.1

See application file for complete search history.

(56) References Cited

U.S. PATENT DOCUMENTS

| | | | | |
|---|---|---|---|---|
| 2004/0056573 | A1* | 3/2004 | Chae | 312/404 |
| 2007/0001562 | A1* | 1/2007 | Park | 312/333 |
| 2007/0046158 | A1* | 3/2007 | Hoffman | 312/333 |
| 2007/0182292 | A1* | 8/2007 | Huang | 312/221 |

* cited by examiner

*Primary Examiner* — Jermie Cozart

(57) ABSTRACT

A self-closing drawer slide for a refrigerator includes a slide assembly operable between expanded and non-expanded positions and having first and second slides that are slidably engaged. The first slide is removably attached directly or indirectly to the refrigerator interior wall. An actuator is operably coupled to the second slide. A modular self-closing mechanism is releasably attached to an interior refrigerator wall separate from the slide assembly. A slider is attached to a spring and slidably engaged with the self-closing mechanism. The slider is positionable by the actuator between extended and retracted positions. The slider is adapted to be disengaged from the extended position by the actuator, allowing slider movement to the retracted position under force of the spring and which consequently pulls the actuator and a third slide, causing slide assembly movement to the non-expanded position.

20 Claims, 16 Drawing Sheets

INDEPENDENT SELF-CLOSE MECHANISM FOR PULLOUT DRAWER

CROSS-REFERENCE TO RELATED APPLICATIONS

The present application represents a divisional application of U.S. patent application Ser. No. 12/560,477 entitled "Independent Self-Close Mechanism for a Pull-Out Drawer" filed Sep. 16, 2009, U.S. Pat. No. 8,282,177 B2.

BACKGROUND OF THE PRESENT INVENTION

The present invention generally relates to an independent self-close mechanism for a pullout drawer, and more specifically, to a self-close mechanism that does not interface directly with a drawer slide.

SUMMARY OF THE INVENTION

In one aspect of the present invention, a self-closing drawer slide for a refrigerator includes a slide assembly operable between an expanded position and a non-expanded position and having first and second slides that are slidably engaged. The first slide is removably attached directly or indirectly to the interior wall of the refrigerator. An actuator is operably coupled to the second slide. A modular self-closing mechanism is releasably attached to an interior wall of the refrigerator separate from the slide assembly. A slider is attached to a spring and slidably engaged with the self-closing mechanism. The slider is positionable by the actuator between an extended position and a retracted position. The slider is adapted to be disengaged from the extended position by the actuator, which allows the slider to move toward the retracted position under force of the spring and which consequently pulls the actuator, causing the slide assembly to move toward the non-expanded position.

In another aspect of the present invention, a refrigerator includes a door and a cabinet having an interior wall. A slide assembly is operable between expanded and non-expanded positions. A first slide is slidable relative to a second slide. The first slide is removably attached to the interior wall of the cabinet. The second slide includes an actuator that travels along a linear path as the slide assembly moves between the expanded and non-expanded positions. A self-closing mechanism is connected with the interior wall of the cabinet separate from the slide assembly and includes a spring-biased slider. The spring-biased slider is aligned with the linear path of the actuator and is positionable by the actuator between an extended position when the slide assembly is in the expanded position and a retracted position when the slide assembly is in the non-expanded position. The spring-biased slider is biased to the retracted position and adapted to be disengaged from the extended position by the actuator which disengagement allows the spring-biased slider to move to the retracted position and pull the actuator and second slide, thereby causing the slide assembly to move into the non-expanded position. A food storage space is detachably connected to the second slide.

In yet another aspect of the present invention, a method of opening a refrigerator drawer includes removably attaching a slide assembly that is operable between expanded and non-expanded positions to an interior wall of a refrigerator. A drawer is connected operable between open and closed positions to the slide assembly. A modular self-closing mechanism is removably attached to the interior wall of the refrigerator separate from the slide assembly. The self-closing mechanism includes a spring-biased slider positionable between a retracted position and an extended position. An actuator is removably attached on the slide assembly in sliding alignment with the spring-biased slider. The drawer is pulled to the open position, thereby causing the actuator to engage the spring-biased slider and place the spring-biased slider in the extended position.

These and other features, advantages and objects of the present invention will be further understood and appreciated by those skilled in the art upon studying the following specification, claims, and appended drawings.

DETAILED DESCRIPTION OF EMBODIMENTS

Figure 1A:
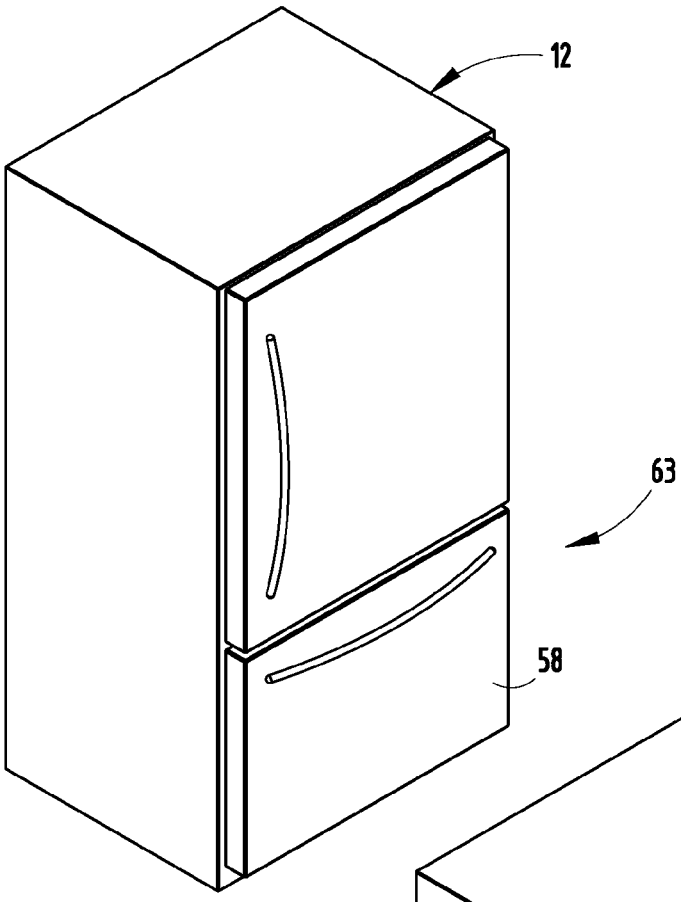
FIG. 1A is a top perspective view of a refrigerator incorporating one embodiment of a self-closing mechanism of the present invention.
Figure 1B:
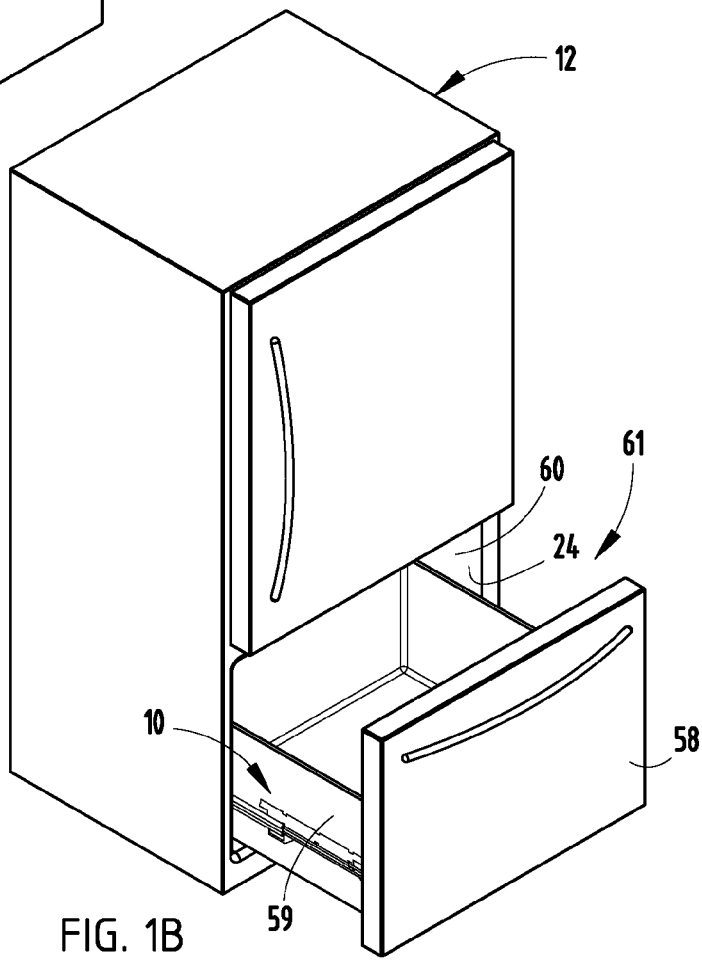
FIG. 1B is a partial top view of the refrigerator of FIG. 1A with the freezer drawer door open.
Figure 2A:
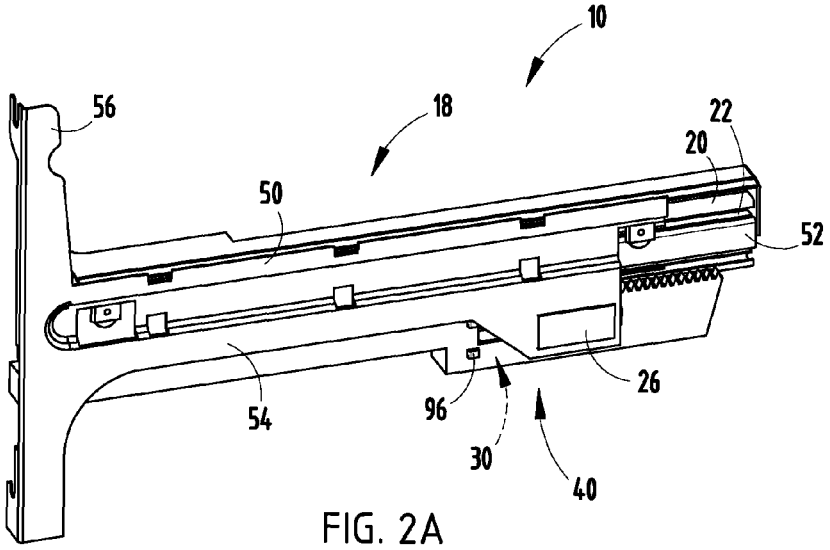
FIG. 2A is a top perspective view of one embodiment of a non-expanded drawer slide of the present invention.

For purposes of description herein the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIGS. 1A-2B, 5A, and 5B, the reference numeral 10 generally designates a self-closing drawer slide for a refrigerator 12 having a slide assembly 14 operable between an expanded position 16 and a non-expanded position 18 and having first and second slides 20, 22 that are slidably engaged. The first slide 20 is removably operably coupled to an interior wall 24 of the refrigerator 12. An actuator 26 is removably operably coupled to the second slide 22. A modular self-closing mechanism 30 is removably operably coupled to the interior wall 24 of the refrigerator 12 separate from the slide assembly 14. A slider 32 is attached to a spring 36 and slidably engaged with the self-closing mechanism 30. The slider 32 is positionable by the actuator 26 between an extended position 38 and a retracted position 40. The slider 32 is adapted to be disengaged from the extended position 38 by the actuator 26, which allows the slider 32 to move toward the retracted position 40 under force of the spring 36 and which consequently pulls the actuator 26, causing the slide assembly 14 to move toward the non-expanded position 18.

Figure 2B:
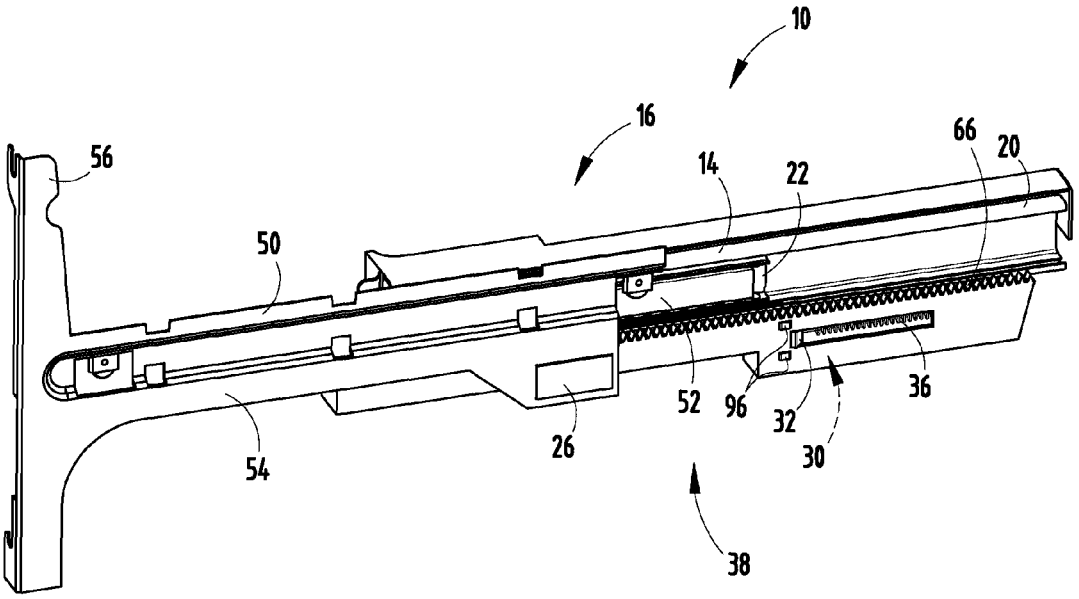
FIG. 2B is a top perspective view of the drawer slide of FIG. 2A with the drawer slide expanded.
Figure 2C:
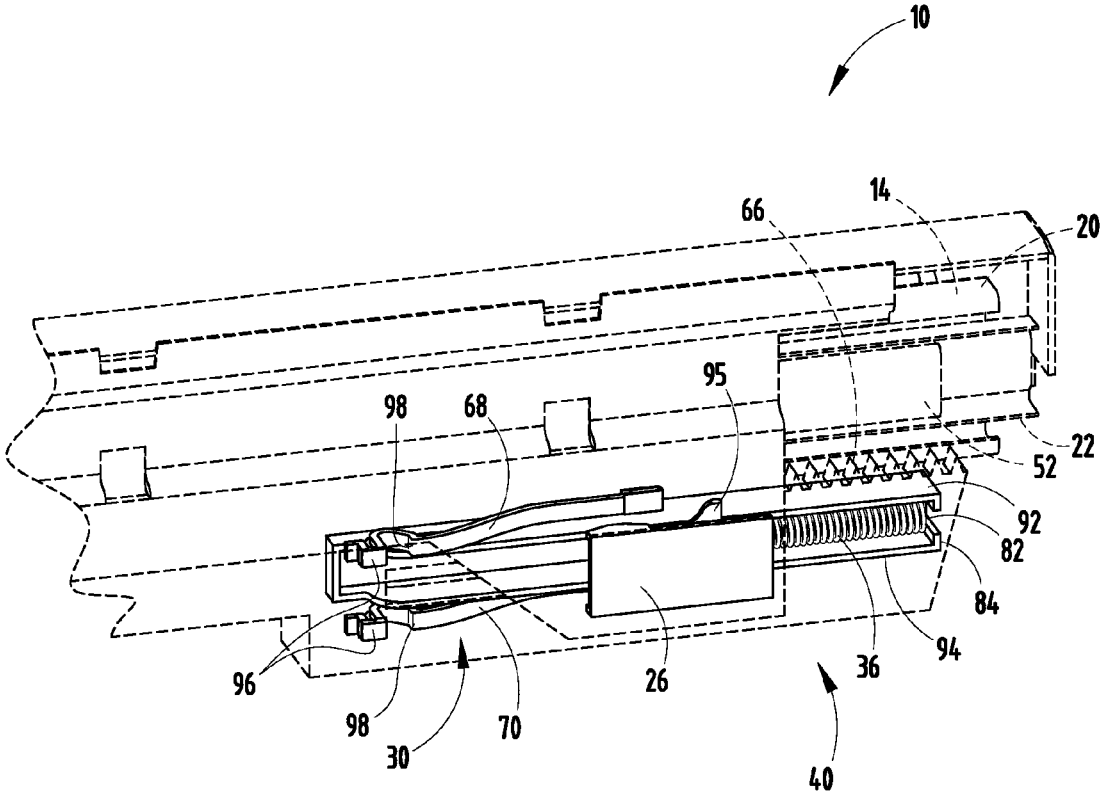
FIG. 2C is an enlarged partial top perspective view of one embodiment of a self-closing mechanism and actuator of the present invention.

Referring again to FIGS. 1A-2C, the slide assembly 14 includes a slide bracket 50 that is fixedly attached to the second slide 22. A third slide 52 may be disposed between the first and second slides 20, 22 to provide additional expandable length to the slide assembly 14. The slide bracket 50 includes a body portion 54 parallel with the second slide 22 and a perpendicular portion 56 adapted to engage a drawer door 58 or drawer 59 (FIG. 1B) on an appliance, such as the refrigerator 12. As shown in FIG. 2B, the drawer slide 10, when in the expanded position 16, allows a user to access the drawer 59, which has an interior cabinet 60 (FIG. 1B), such as a freezer bin or refrigerated food storage bin, that is supported on and disposed behind the drawer door 58. The interior cabinet 60 defines a food storage space for holding food goods. When the drawer slide 10 is in the expanded position 16, the drawer 59 is in an open position 61 (FIG. 1B). Likewise, when the drawer slide 10 is in the non-expanded position 18, the drawer 59 is in a closed position 63 (FIG. 1A). In addition, although only the drawer slide 10 disposed on the left interior wall 24 is illustrated, it should be understood that the drawer slide 10 disposed on the right interior wall 24 is constructed similarly, but with a minor image configuration.

Figure 3A:
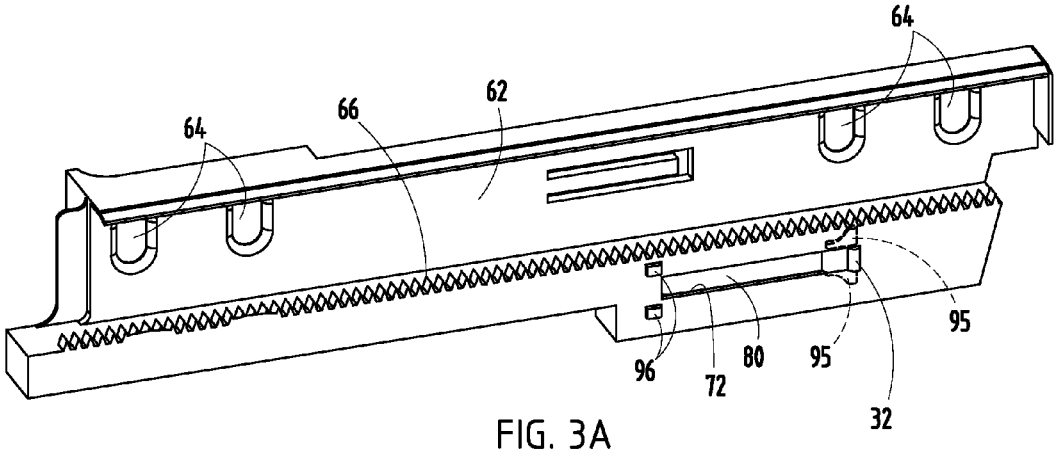
FIG. 3A is a top perspective view of one embodiment of a side adapter of the present invention.
Figure 3B:
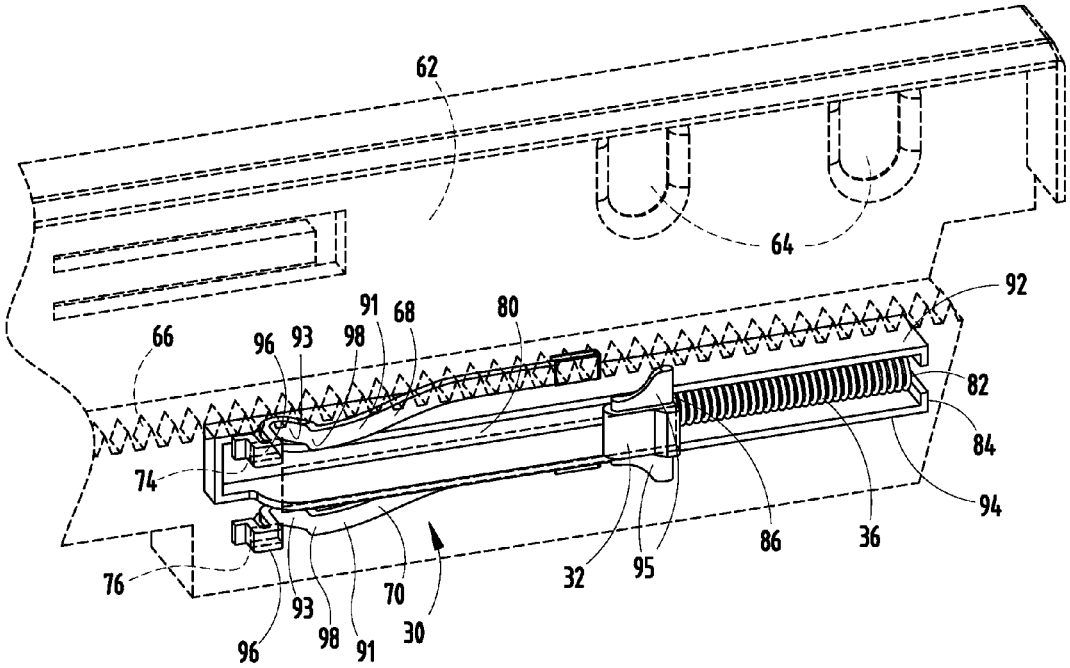
FIG. 3B is a top perspective view of the side adapter of FIG. 3A in phantom and showing the self-closing mechanism installed in the side adapter.

Referring to FIGS. 3A and 3B, the self-closing mechanism 30 is disposed inside a side adapter 62 that is connected with the interior wall 24 of the refrigerator 12. The side adapter 62 includes a number of apertures 64 for receiving mechanical fasteners to connect the side adapter 62 to the interior wall 24. In addition, the side adapter 62 includes a plurality of teeth 66 adapted to engage a rack and pinion gear system (not shown) that assists in keeping the drawer door 58 aligned during opening and closing of the drawer door 58, minimizing the likelihood of binding. The actuator 26 is disposed over the self-closing mechanism 30 (FIG. 2C) and is designed to engage slider 32 as well as first and second latch springs 68, 70 that extend from the self-closing mechanism 30.

Figure 4:
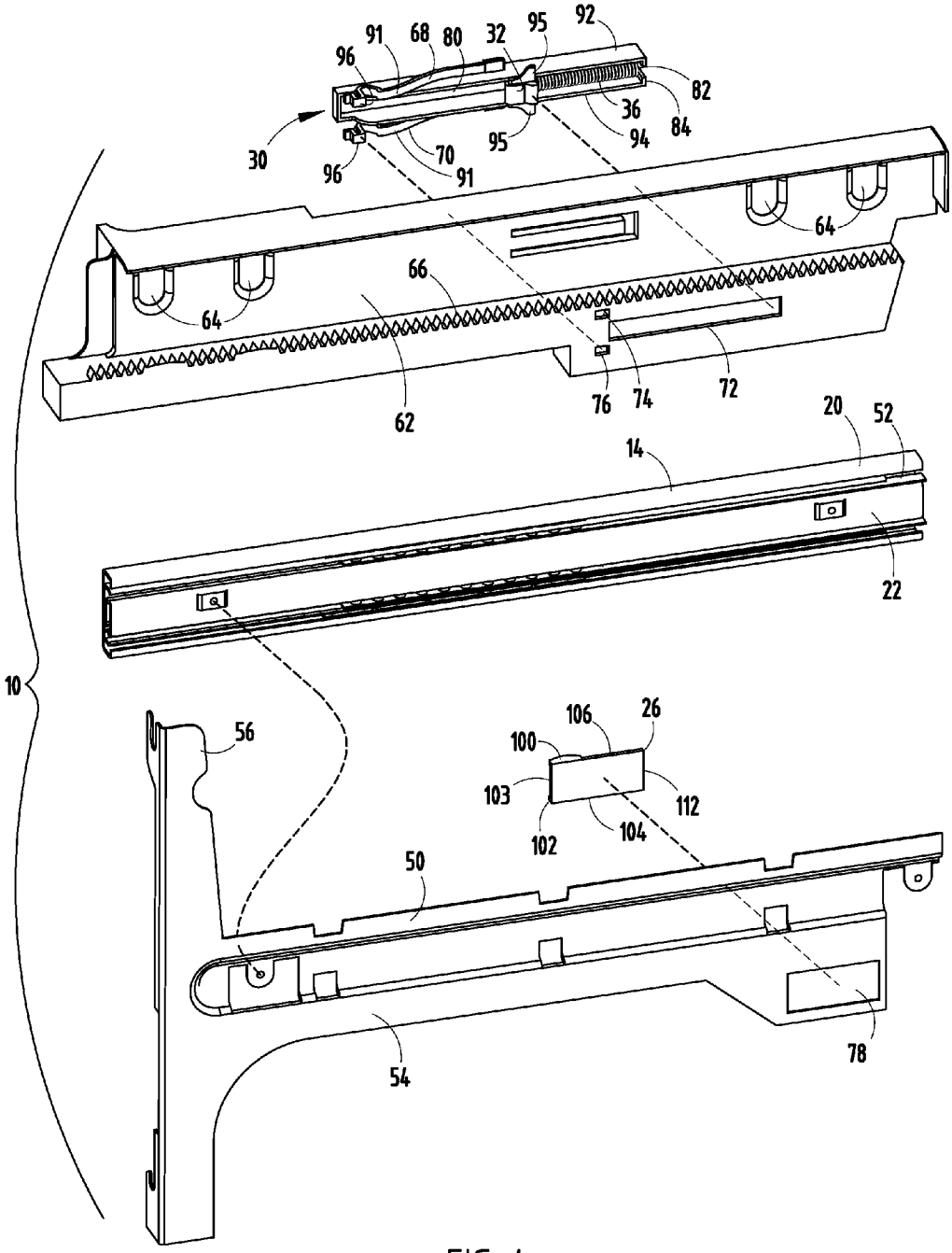
FIG. 4 is an exploded top perspective view of the drawer slide and self-closing mechanism of FIG. 2A.

Referring to FIG. 4, it should be noted that the slide assembly 14 does not include the self-closing mechanism 30. More specifically, the self-closing mechanism 30 is disposed in the side adapter 62 and is engaged by the actuator 26, which is disposed in the slide bracket 50. Accordingly, the slide assembly 14 is free of any bias when removed from the drawer slide 10. The slide bracket 50 includes an aperture 78 adapted to receive the actuator 26. Likewise, the side adapter 62 includes an elongated aperture 72 that receives the slider 32 and allows for movement of the slider 32 between the expanded and non-expanded positions 16, 18. First and second apertures 74, 76 also receive a portion of the self-closing mechanism 30, as detailed below.

Figure 5A:
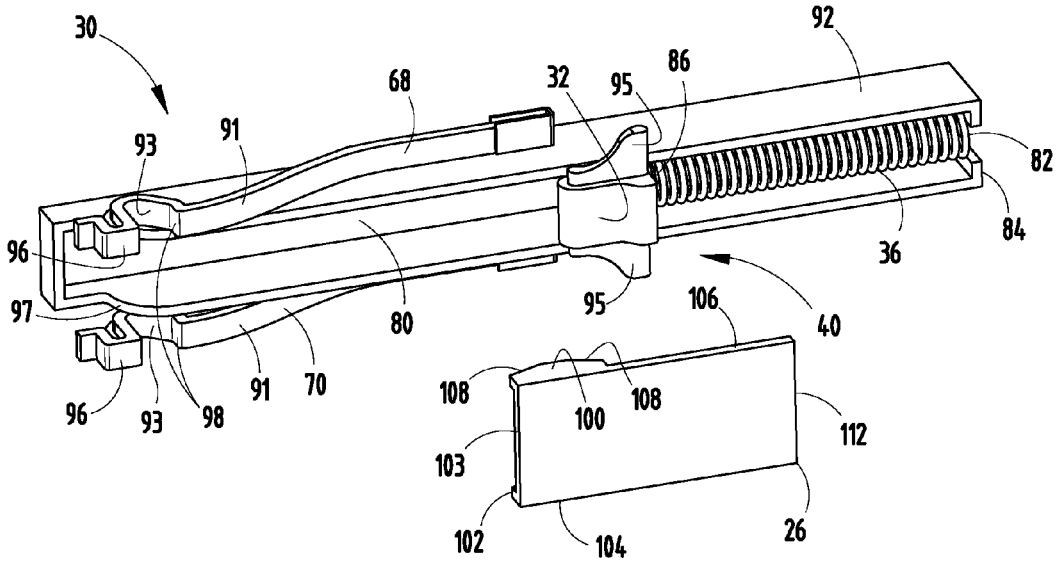
FIG. 5A is a top perspective partially exploded view of the self-closing mechanism with the slider in the retracted position.
Figure 5B:
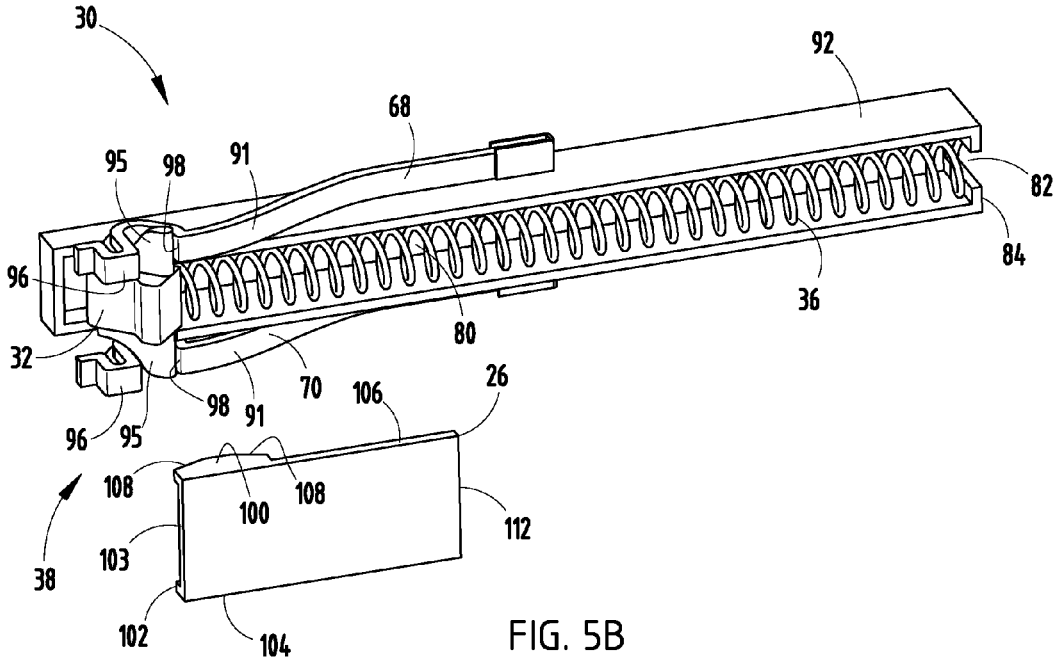
FIG. 5B is a top perspective partially exploded view of the self-closing mechanism with the slider in the extended position.

Referring to FIGS. 5A and 5B, the slider 32 is disposed over a trough 80 of the self-closing mechanism 30. A rear portion 82 of the spring 36 is connected to a rear portion 84 of the self-closing mechanism 30 and a forward portion 86 of the spring 36 is connected to the slider 32. The self-closing mechanism 30 includes first and second latch springs 68, 70 that extend from top and bottom sidewalls 92, 94 (FIG. 4) of the self-closing mechanism 30. Each sidewall 92, 94 includes a forward cam portion 97. The latch springs 68, 70 of the self-closing mechanism 30 are made of plastic or other resilient material and are designed to hold the slider 32 in the extended position 38. The latch springs 68, 70 each include a ramp 91 (FIG. 8A) that terminates at a slot 93 that is designed to receive wings 95 that act as latch spring engagement members and which extend from top and bottom portions of the slider 32. The slot 93 is positioned between an engagement knob 96 and an abutment portion 98. The abutment portion 98 is designed to abut the wings 95, securing the slider 32 in the expanded position 16 (FIG. 2B). The slider 32 is designed for movement between the expanded and non-expanded positions 16, 18 by the actuator 26. In the illustrated embodiments of FIGS. 5A and 5B, the slide assembly 14, slide bracket 50, and other components have been removed to show the functionality of the self-closing mechanism 30.

Figure 6A:
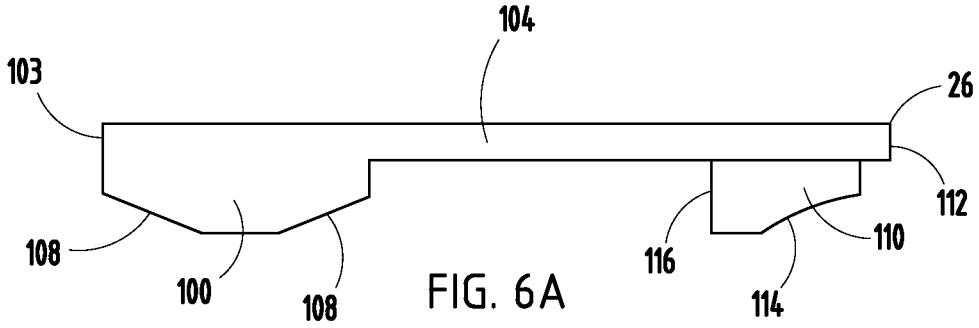
FIG. 6A is a bottom elevational view of one embodiment of an actuator of the present invention.
Figure 6B:
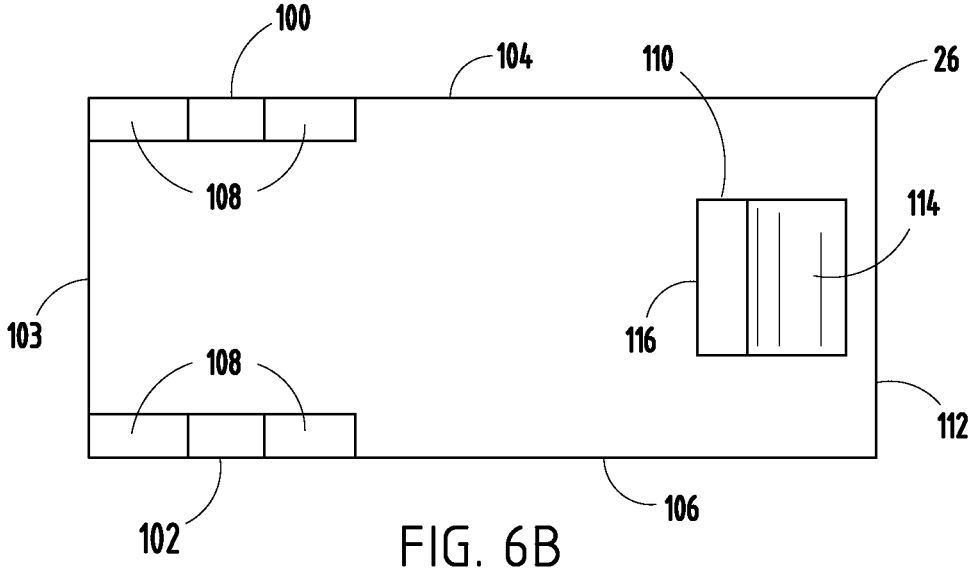
FIG. 6B is a side elevational view of the actuator of FIG. 6A.
Figure 6C:
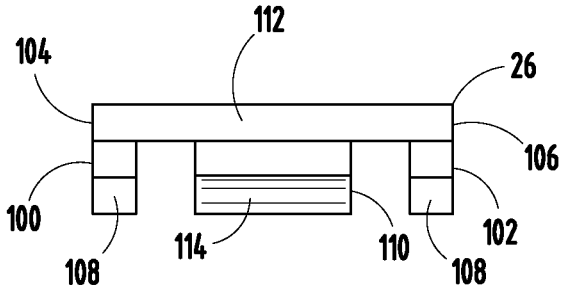
FIG. 6C is a rear elevational view of the actuator of FIG. 6A.

Referring to FIGS. 6A-6C, the actuator 26 includes first and second protuberances 100, 102 that extend from a forward end 103 on top and bottom sides 104, 106 of the actuator 26. The protuberances 100, 102 have forward and rearward slanted edges 108 designed to engage and move the engagement knob 96 of each latch spring 68, 70. In addition, the actuator 26 includes a central engagement head 110 on a rearward side 112 of the actuator 26, which is disposed approximately vertically central on the actuator 26. The engagement head 110 includes a perpendicular abutment side 116, and a curvilinear rearward side 114. It is contemplated that the actuator 26 could have a different construction with similar characteristics.

Referring now to FIGS. 7A-15C, operation of the self-closing mechanism 30 will be explained in detail. It will be understood that, during operation, the self-closing mechanism 30 will be implemented in the slide assembly 14, as will the actuator 26. It will also be understood by one having ordinary skill in the art that the self-closing mechanism 30 could be installed in a variety of drawer slides 10 separate from the slide assemblies 14 themselves.

Figure 7A:
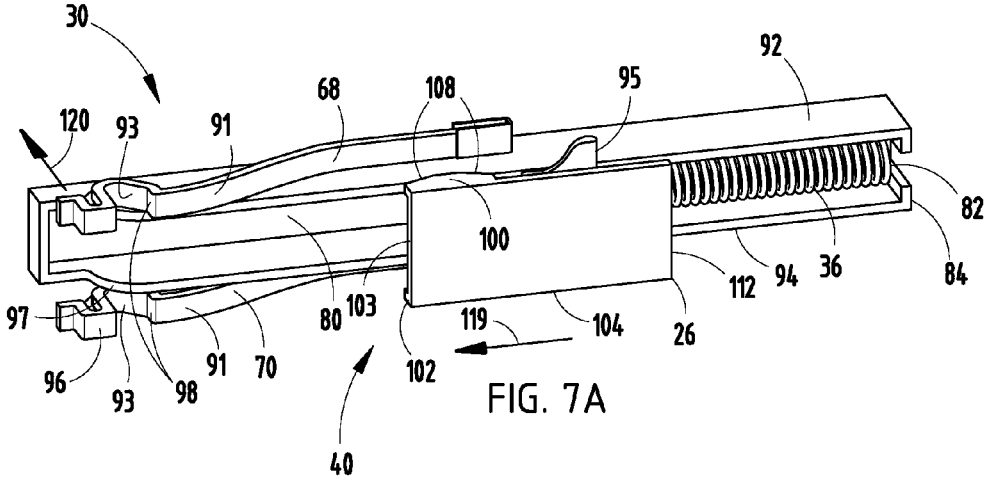
FIG. 7A is a top perspective view of the self-closing mechanism with the slider in the retracted position.
Figure 7B:
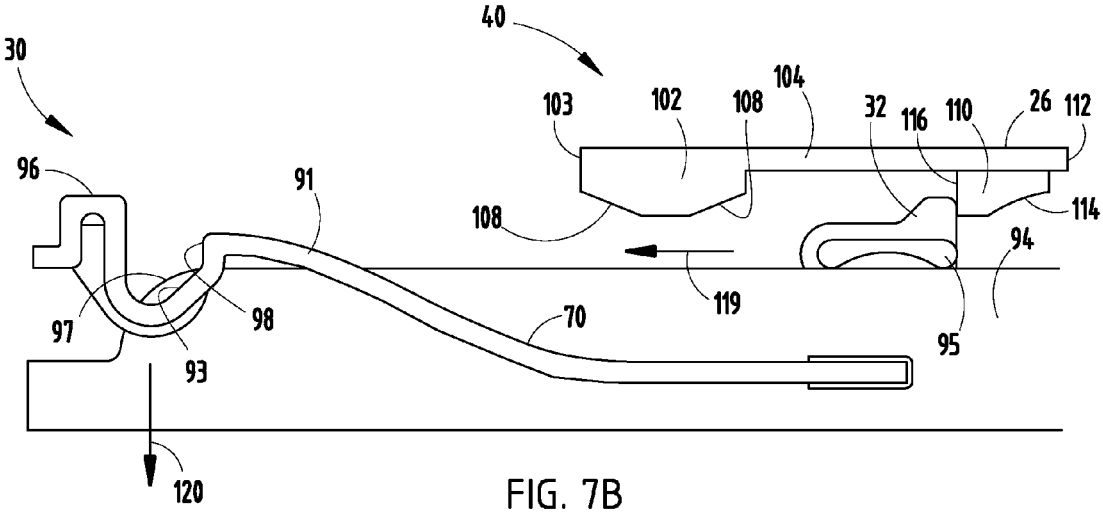
FIG. 7B is a bottom elevational view of the self-closing mechanism of FIG. 7A.
Figure 7C:
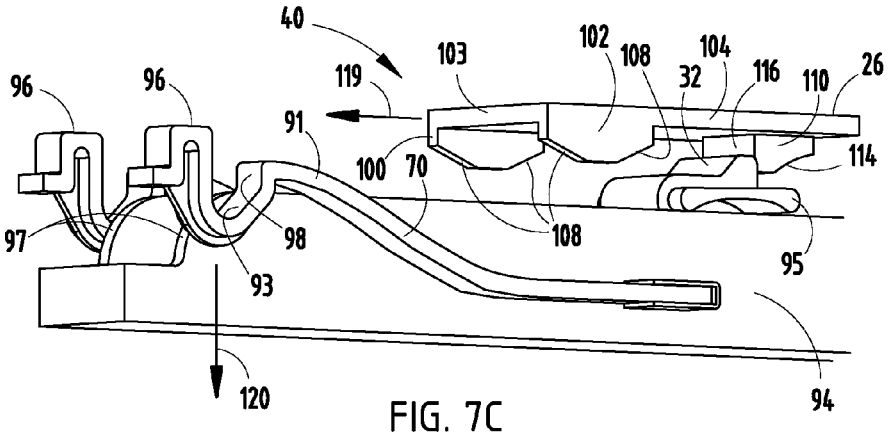
FIG. 7C is a bottom perspective view of the self-closing mechanism of FIG. 7A.
Figure 8A:
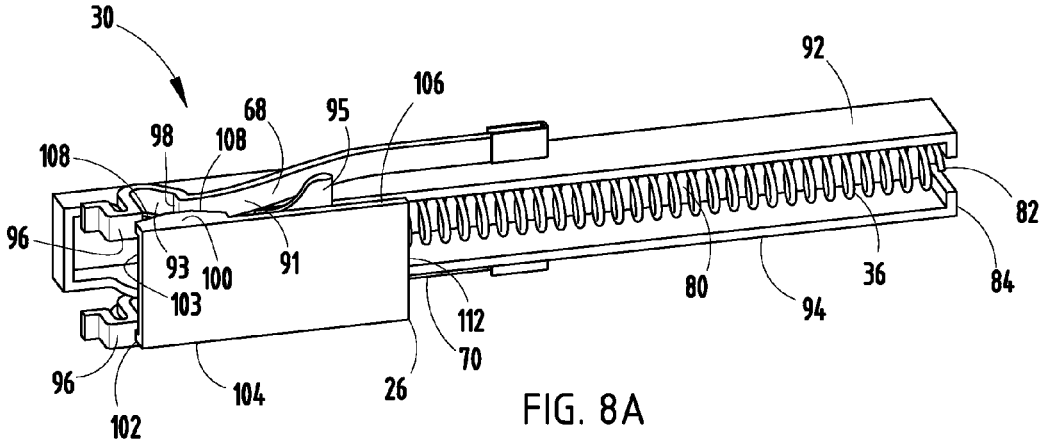
FIG. 8A is a top perspective view of the self-closing mechanism with the slider entering the extended position.
Figure 8B:
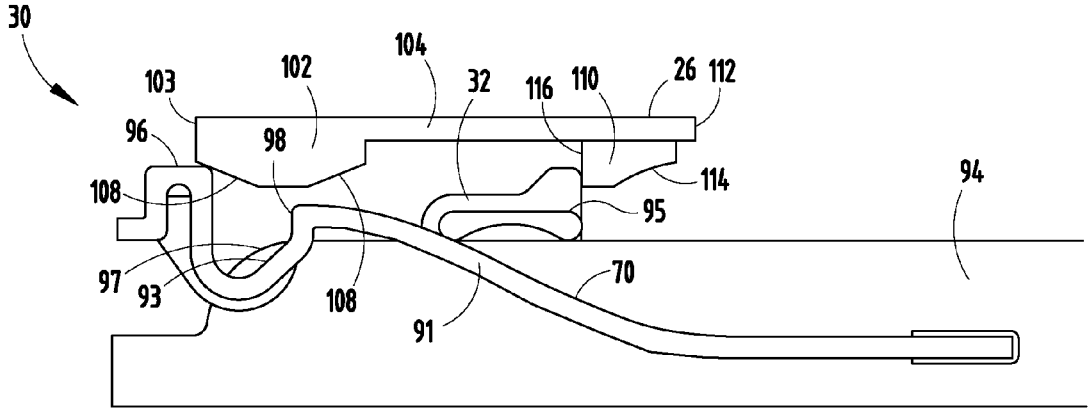
FIG. 8B is a bottom elevational view of the self-closing mechanism of FIG. 8A.
Figure 8C:
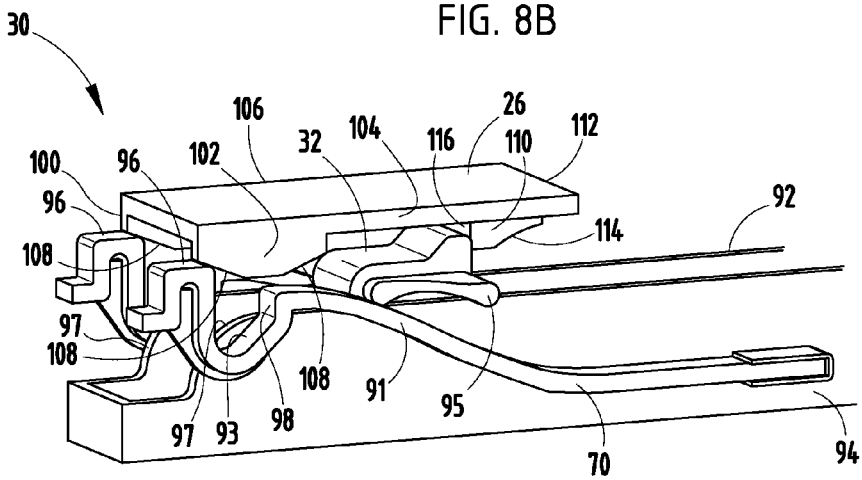
FIG. 8C is a bottom perspective view of the self-closing mechanism of FIG. 8A.

Referring to the embodiment illustrated in FIGS. 7A-7C, when the drawer door 58 is being opened, the slide bracket 50 and second slide 22 are drawn outward, such that the abutment side 116 of the engagement head 110 of the actuator 26 abuts the slider 32, which is in the non-expanded position 18. When the slider 32 is in the non-expanded position 18 (FIGS. 7A-7C), there is little or no tensile force from the spring 36 acting on the slider 32. When the drawer door 58 is pulled outward, the actuator 26 abuts the slider 32 and pulls the slider 32 along a linear path in the direction of arrow 119 over the trough 80 along the first and second walls 92, 94 of the self-closing mechanism 30, as shown in FIGS. 8A-8C. When the actuator 26 reaches the latch springs 68, 70, the first and second protuberances 100, 102 abut the engagement knobs 96 of the latch springs 68, 70 and force them inward in the direction of arrow 120 towards the interior wall 24 of the refrigerator 12. At the same time, the slider 32 is forced by the engagement head 110 of the actuator 26 forward and the wings 95 of the slider 32 also abut ramps 91 on the latch springs 68, 70, thereby assisting in pushing the latch springs 68, 70 in the direction of arrow 120 toward the interior wall 24 of the refrigerator 12.

Figure 9A:
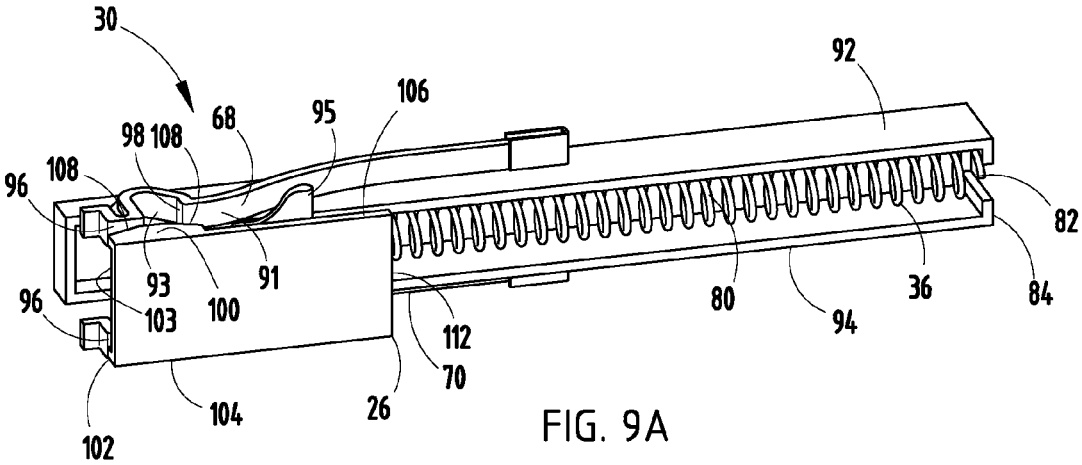
FIG. 9A is a top perspective view of the self-closing mechanism with the actuator engaging the spring arms.
Figure 9B:
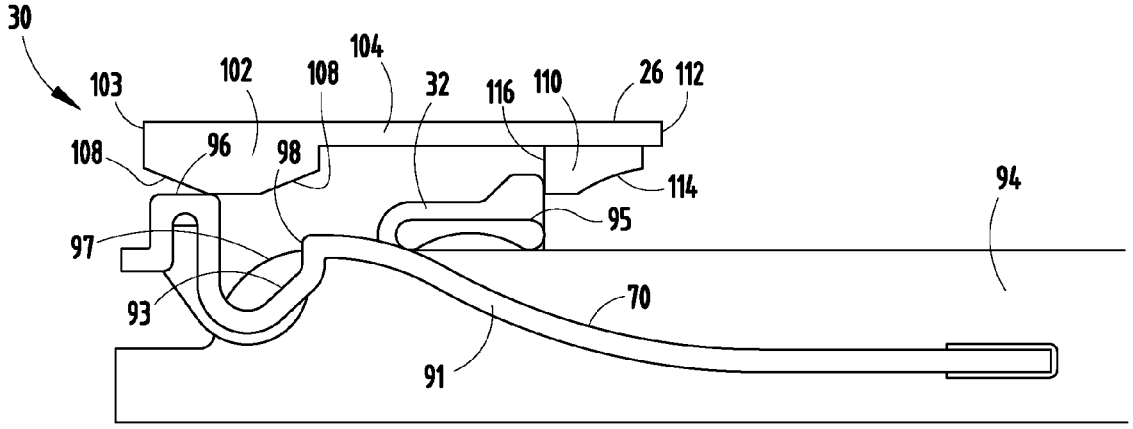
FIG. 9B is a bottom elevational view of the self-closing mechanism of FIG. 9A.
Figure 9C:
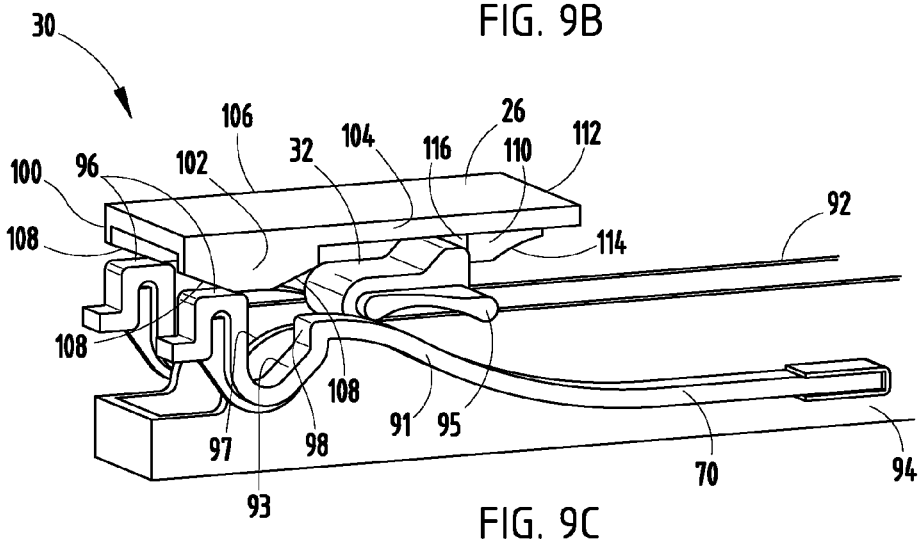
FIG. 9C is a bottom perspective view of the self-closing mechanism of FIG. 9A.
Figure 10A:
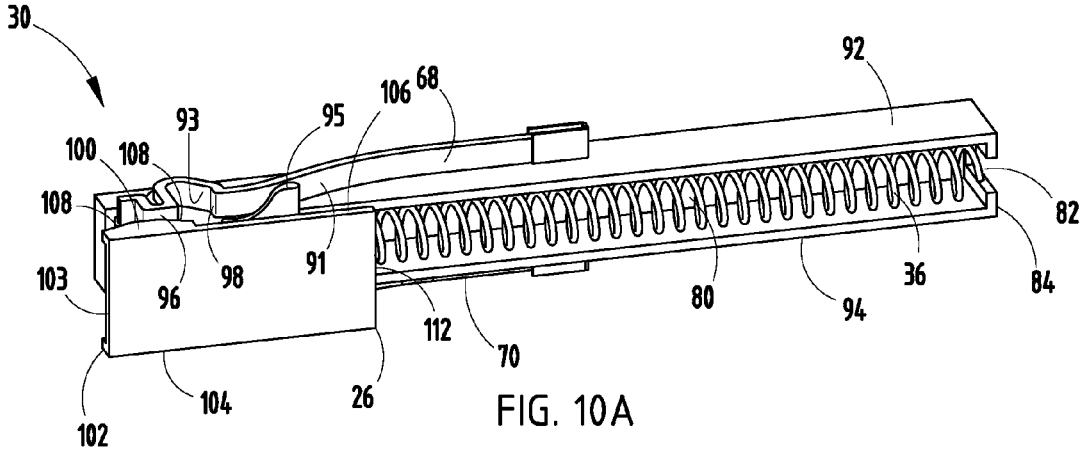
FIG. 10A is a top perspective view of the self-closing mechanism with the actuator engaging the slider.
Figure 10B:
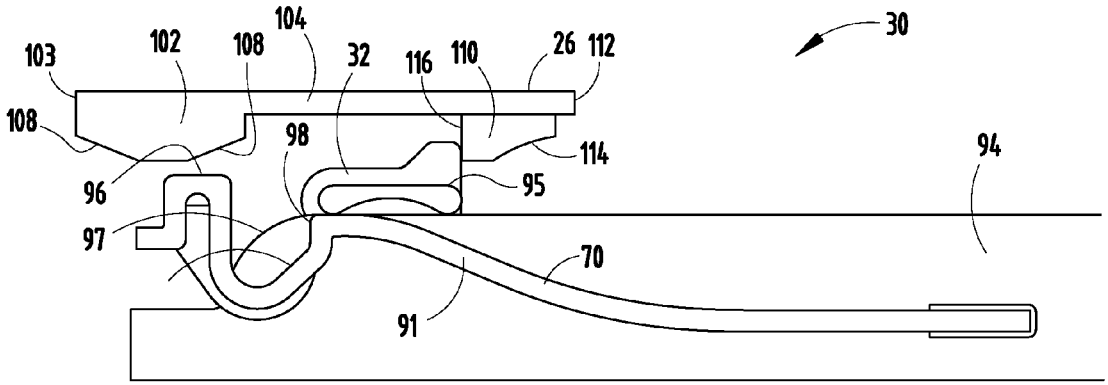
FIG. 10B is a bottom elevational view of the self-closing mechanism of FIG. 10A.
Figure 10C:
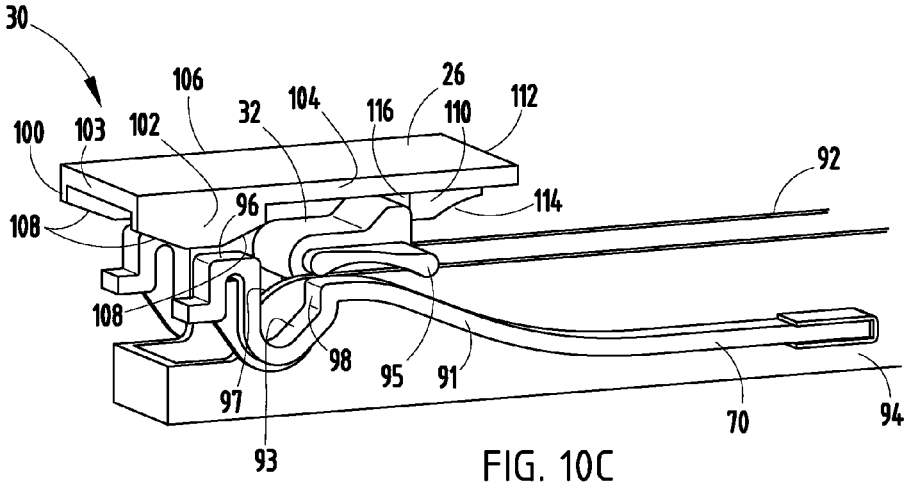
FIG. 10C is a bottom perspective view of the self-closing mechanism of FIG. 10A.

Referring to FIGS. 9A-9C, while the latch springs 68, 70 are pushed inward in the direction of arrow 120, the slider 32 continues to move forward until contact between the protuberances 100, 102 and the engagement knobs 96 of the latch springs 68, 70 are no longer in abutting engagement. In this position, the wings 95 of the slider 32 are forcing the ramps 91 of the latch springs 68, 70 inward in the direction of arrow 120 toward the interior wall 24 of the refrigerator 12.

Figure 11A:
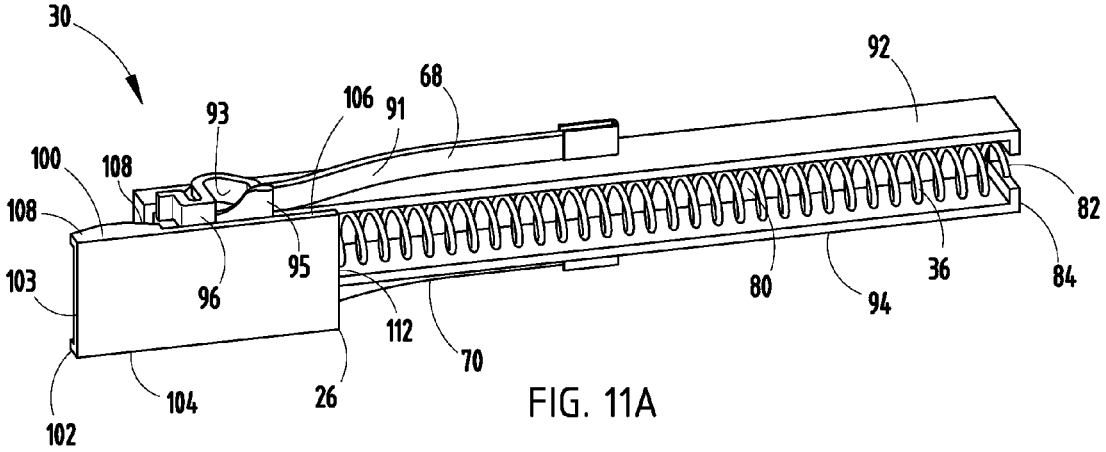
FIG. 11A is a top perspective view of the self-closing mechanism with the slider rotating away from the actuator.
Figure 11B:
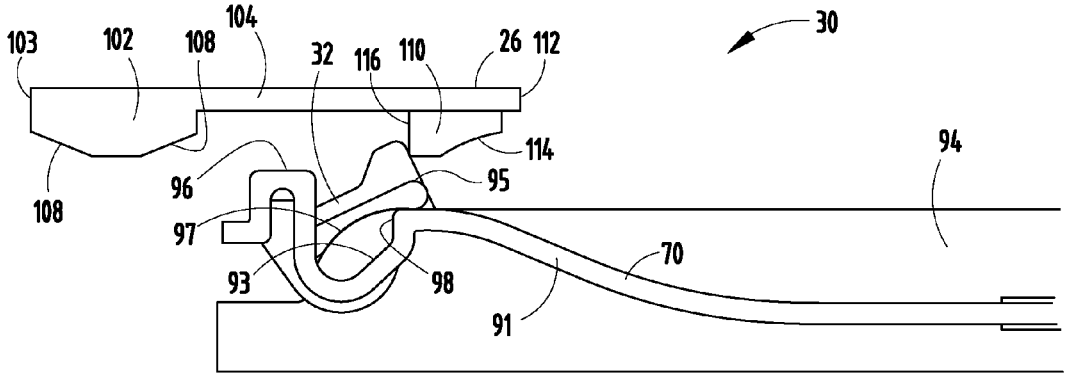
FIG. 11B is a bottom elevational view of the self-closing mechanism of FIG. 11A.
Figure 11C:
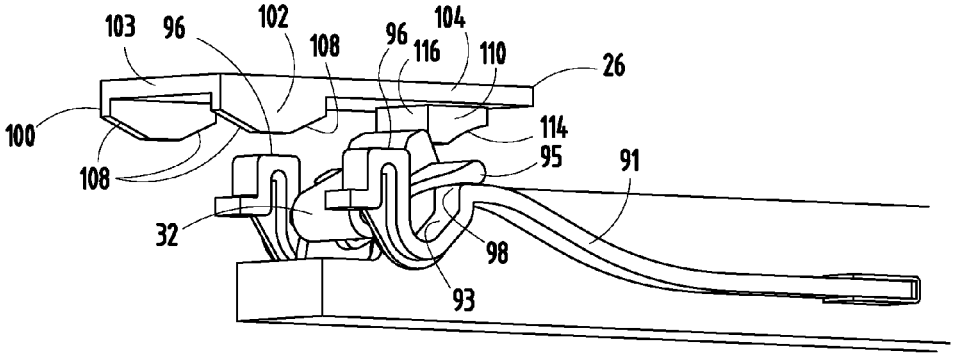
FIG. 11C is a bottom perspective view of the self-closing mechanism of FIG. 11A.
Figure 12A:
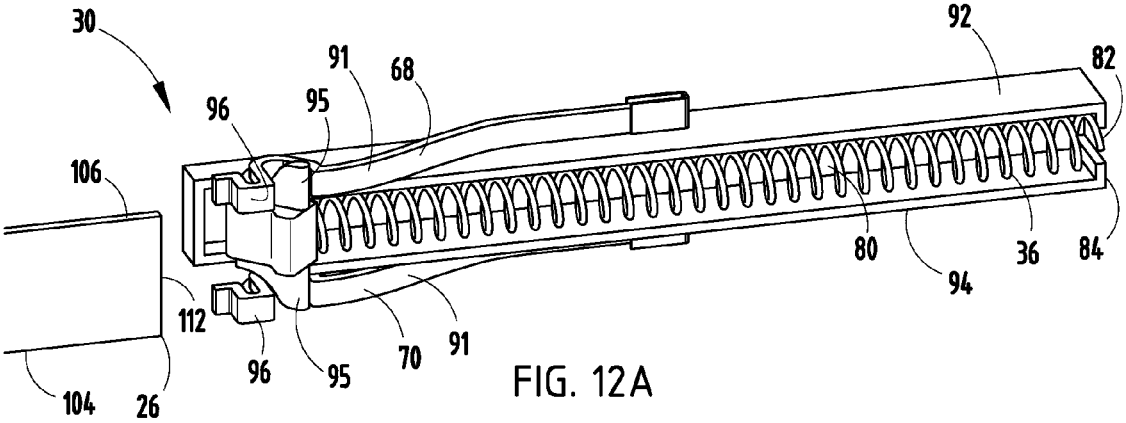
FIG. 12A is a top perspective view of the self-closing mechanism with the slider in the extended position.
Figure 12B:
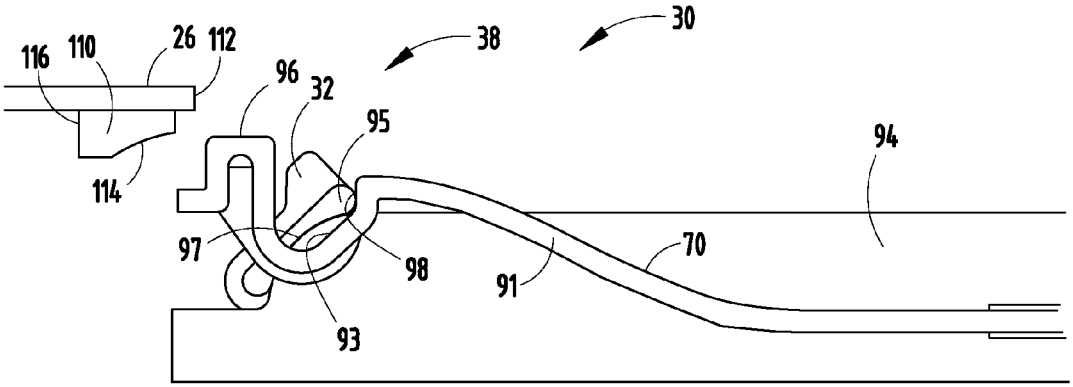
FIG. 12B is a bottom elevational view of the self-closing mechanism of FIG. 12A.
Figure 12C:
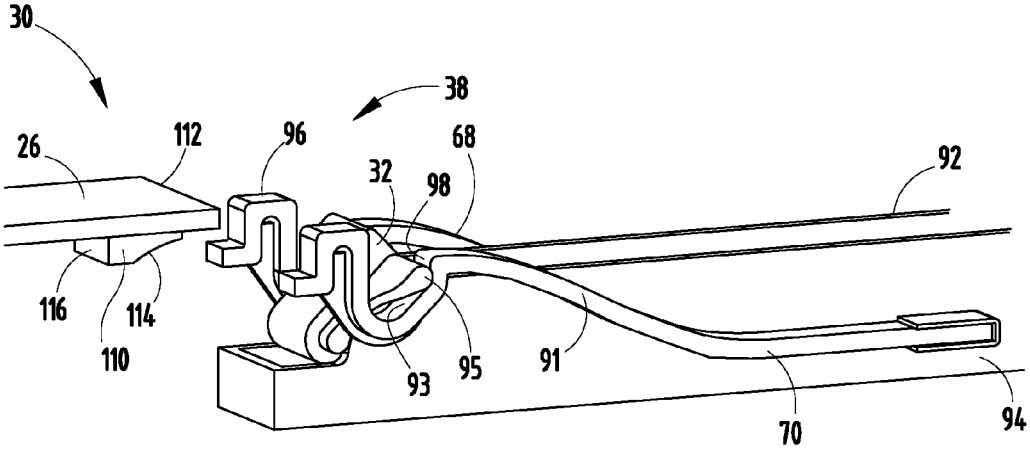
FIG. 12C is a bottom perspective view of the self-closing mechanism of FIG. 12A.

Referring to FIGS. 11A-12C, as the drawer door 58 continues to be pulled outward, the slider 32 begins to rotate about the cam portion 97 on the self-closing mechanism 30 (FIGS. 11A-11C). As the slider 32 rotates about the cam portion 97, the ramps 91 of the latch springs 68, 70 remain in contact with the wings 95 of the slider 32 until the wings 95 clear the ramps 91 and pass into the slots 93 of the latch springs 68, 70 (FIGS. 12A-12C). The actuator 26 has now passed the self-closing mechanism 30 as the drawer slide 10 continues to be pulled outward. The slider 32 is held in place by the abutment of the wings 95 with the abutment portion 98 of the latch springs 68, 70, preventing the slider 32 from being drawn by the biasing force of the spring 36 to the non-expanded position 18. As long as the drawer door 58 is open, the wings 95 of the slider 32 remain in abutting contact with the abutment portion 98 of the latch springs 68, 70 and the spring 36 remains extended.

Figure 13A:
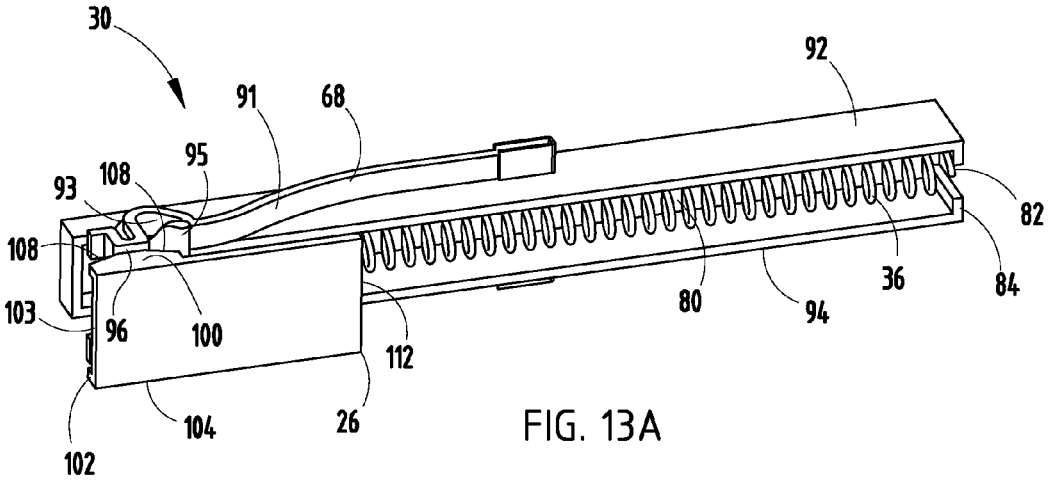
FIG. 13A is a top perspective view of the self-closing mechanism with the actuator engaging the spring arms.
Figure 13B:
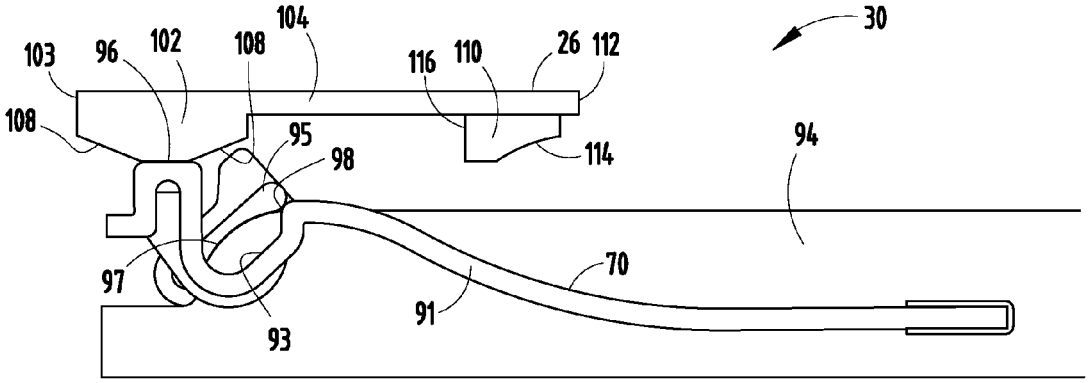
FIG. 13B is a bottom elevational view of the self-closing mechanism of FIG. 13A.
Figure 13C:
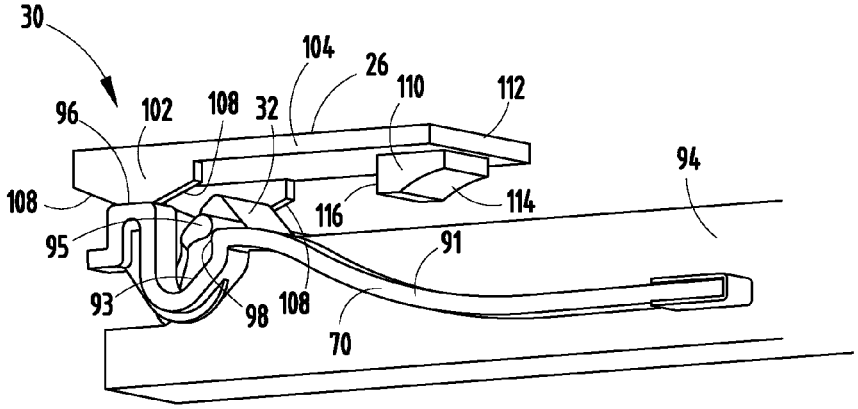
FIG. 13C is a bottom perspective view of the self-closing mechanism of FIG. 13A.

Referring to FIGS. 13A-13C, when the drawer door 58 is being closed, the actuator 26 once again passes over the self-closing mechanism 30 until the protuberances 100, 102 engage the engagement knobs 96 of the latch springs 68, 70. As the protuberances 100, 102 engage the engagement knobs 96 of the latch springs 68, 70, the latch springs 68, 70 are pushed inward again toward the interior wall 24 of the refrigerator 12 until the abutment portion 98 of the latch springs 68, 70 no longer makes contact with the wings 95 of the slider 32. More specifically, the abutment portion 98 extends below the contact surface of the first and second walls 92, 94 of the self-closing mechanism 30, such that the wings 95 lose contact with the abutment portion 98 of the latch springs 68, 70. The spring 36 is now free to draw the slider 32 back to the non-expanded position 18.

Figure 14A:
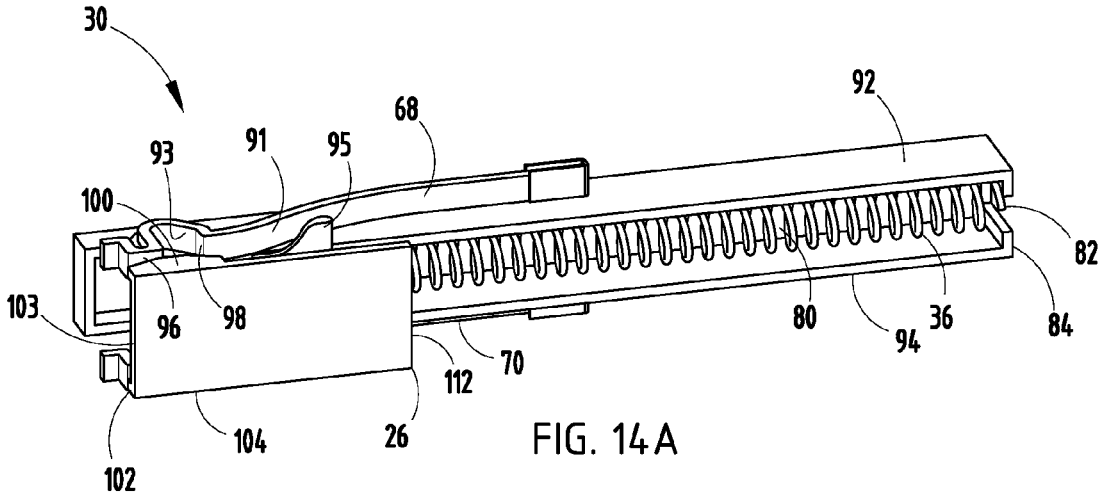
FIG. 14A is a top perspective view of the self-closing mechanism with the slider engaging the actuator.
Figure 14B:
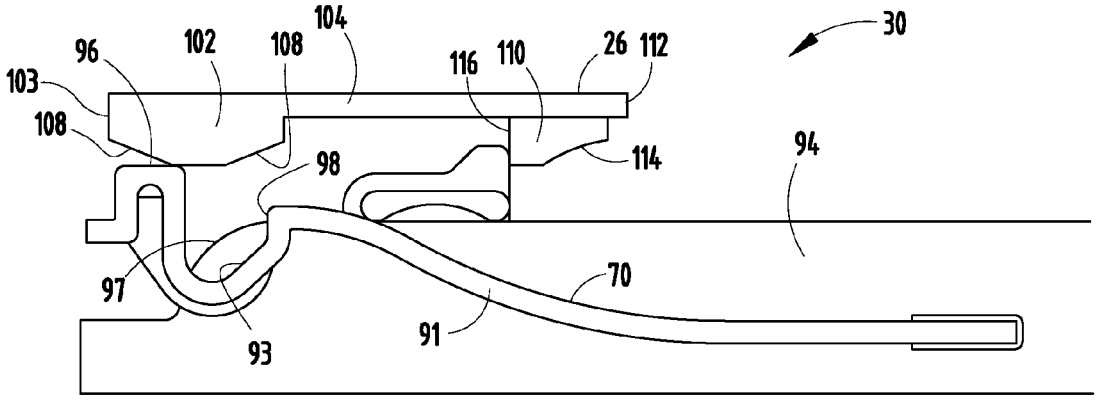
FIG. 14B is a bottom elevational view of the self-closing mechanism of FIG. 14A.
Figure 14C:
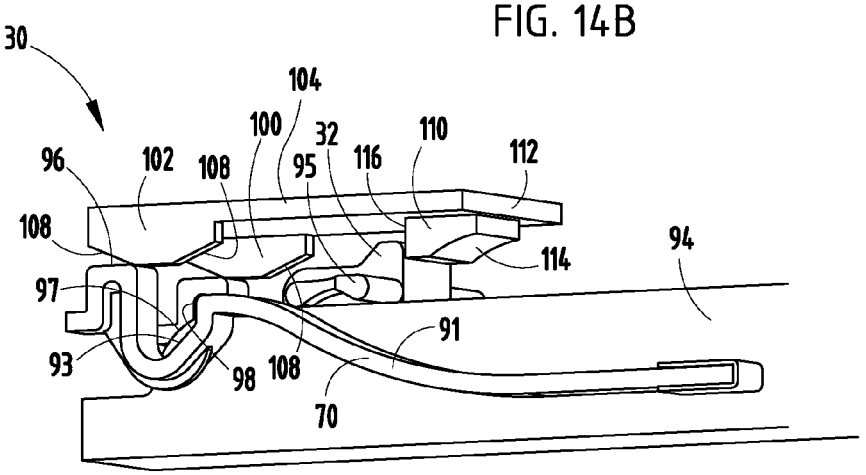
FIG. 14C is a bottom perspective view of the self-closing mechanism of FIG. 14A.
Figure 15A:
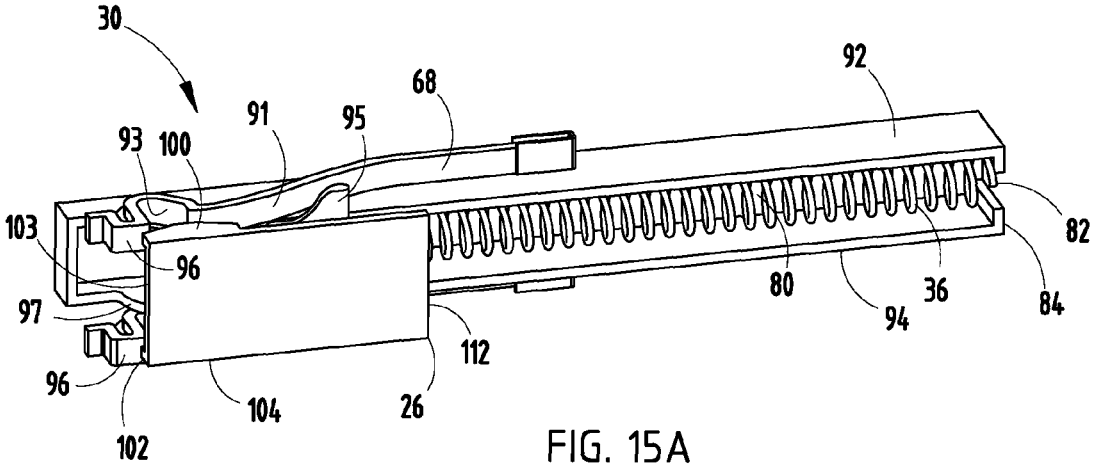
FIG. 15A is a top perspective view of the self-closing mechanism with the slider pulling the actuator and returning to the retracted position.
Figure 15B:
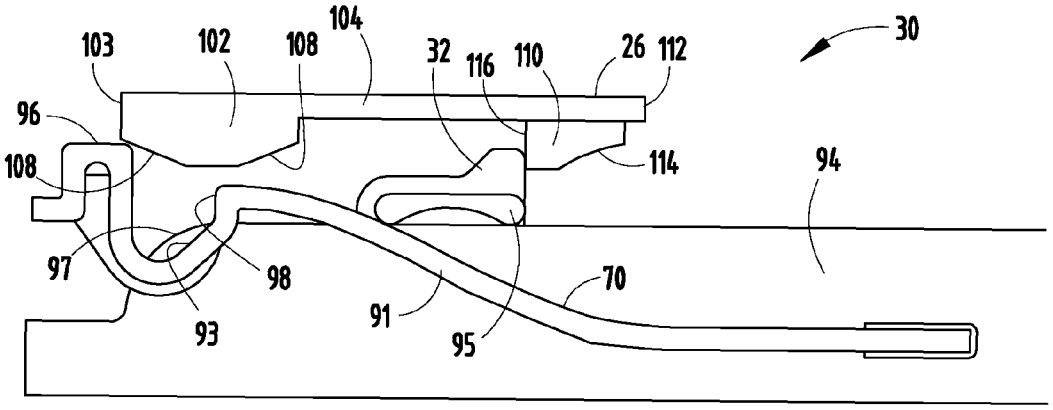
FIG. 15B is a bottom elevational view of the self-closing mechanism of FIG. 15A.
Figure 15C:
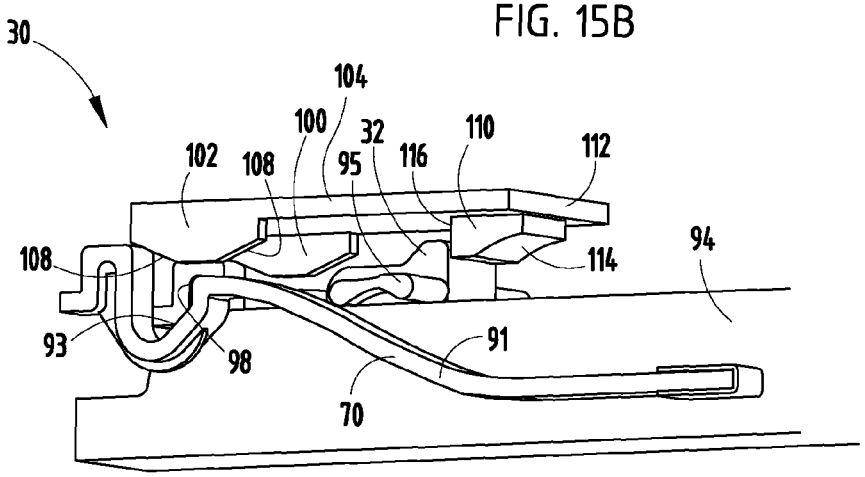
FIG. 15C is a bottom perspective view of the self-closing mechanism of FIG. 15A.

Referring to FIGS. 14A-14C, once the spring 36 is free to draw the slider 32, the slider 32 engages the abutment side 116 of the engagement head 110 of the actuator 26, thus drawing the actuator 26, the slide bracket 50, and the second slide 22 to which the slide bracket 50 is attached, rearward. The protuberances 100, 102 continue to move rearward until they lose contact with the engagement knobs 96 of the latch springs 68, 70, as shown in the embodiment of FIGS. 15A-15C. The latch springs 68, 70 are then free to extend outward away from the interior wall 24 of the refrigerator 12. At the same time, the slider 32 draws the actuator 26, and consequently the drawer slide 10 and drawer door 58, to the closed position. When the slider 32 has reached the non-expanded position 18, the drawer door 58 will have reached the closed position.

It is contemplated that the drawer slide 10 could be used for interior refrigerated food storage compartments of the refrigerator 12 or for a freezer bin door 58. The drawer slide 10 could be installed on one side or both sides of an interior wall 24 of a freezer or refrigerator cabinet. It is also contemplated that the self-closing mechanism 30 could be installed in a variety of positions.

The above description is considered that of the illustrated embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A method of opening a refrigerator drawer comprising:

removably attaching a slide assembly that is operable between expanded and non-expanded positions to an interior wall of a refrigerator;

connecting a drawer operable between open and closed positions to the slide assembly;

removably attaching a modular self-closing mechanism to the interior wall of the refrigerator separate from the slide assembly, the self-closing mechanism having a spring-biased slider positionable between a retracted position and an extended position;

removably attaching an actuator on the slide assembly in sliding alignment with the spring-biased slider, wherein the actuator abuts and pulls the slider along a linear path between a fully expanded position and a fully retracted position;

pulling the drawer to the open position, thereby causing the actuator to engage the spring biased slider and place the spring-biased slider in the extended position; and forming at least one latch spring on the self-closing mechanism that abuts the slider to temporarily retain the slider in the extended position.

2. The method of claim 1, wherein the step of removably attaching a slide assembly that is operable between expanded and non-expanded positions to an interior wall of a refrigerator further comprises:

utilizing a side adapter to connect the slide assembly with the interior wall of the refrigerator.

3. The method of claim 1, further comprising:

supporting a freezer bin on the slide assembly.

4. The method of claim 1, further comprising:

supporting a refrigerated food storage bin on the slide assembly.

5. The method of claim 1, further comprising:

forming at least one latch spring engagement member on the actuator adapted to force the at least one latch spring out of abutment with the slider, thereby allowing the slider to leave the extended position.

6. The method of claim 1, further comprising:

forming a ramp that terminates at a slot that is designed to receive wings on each latch spring that act as latch spring engagement members and which extend from top and bottom portions of the slider.

7. The method of claim 1, further comprising:

aligning a drawer door by including a plurality of teeth on the slide assembly.

8. The method of claim 7, further comprising:

engaging the plurality of teeth with a rack and pinion gear system.

9. The method of claim 1, wherein the step of removably attaching a slide assembly that is operable further comprises:

inserting at least one additional slide between a first and a second slide component.

10. The method of claim 1, further comprising:

creating bias on the slide assembly by inserting a drawer slide.

11. The method of claim 1, further comprising:

biasing the actuator towards the at least one latch spring.

12. The method of claim 1, wherein the step of connecting a drawer operable between open and closed positions to the slide assembly further comprises:

attaching a drawer door fascia on a refrigerator door.

13. The method of claim 1, further comprising:

utilizing a spring as the actuator.

14. A method of opening a refrigerator drawer comprising:

removably attaching a slide assembly that is operable between expanded and non-expanded positions to an interior wall of a refrigerator;

connecting a drawer operable between open and closed positions to the slide assembly;

removably attaching a modular self-closing mechanism to the interior wall of the refrigerator separate from the slide assembly, the self-closing mechanism having a spring-biased slider positionable between a retracted position and an extended position;

removably attaching an actuator on the slide assembly in sliding alignment with the spring-biased slider, wherein the actuator abuts and pulls the slider along a linear path between a fully expanded position and a fully retracted position;

pulling the drawer to the open position, thereby causing the actuator to engage the spring biased slider and place the spring-biased slider in the extended position; and aligning a drawer door by including a plurality of teeth on the slide assembly.

15. The method of claim 14, further comprising:

engaging the plurality of teeth with a rack and pinion gear system.

16. The method of claim 14, further comprising:

creating bias on the slide assembly by inserting a drawer slide.

17. The method of claim 14, further comprises:

biasing the actuator towards the at least one latch spring.

18. A method of opening a refrigerator drawer comprising:

removably attaching a slide assembly that is operable between expanded and non-expanded positions to an interior wall of a refrigerator;

connecting a drawer operable between open and closed positions to the slide assembly;

removably attaching a modular self-closing mechanism to the interior wall of the refrigerator separate from the slide assembly, the self-closing mechanism having a spring-biased slider positionable between a retracted position and an extended position;

removably attaching an actuator on the slide assembly in sliding alignment with the spring-biased slider, wherein the actuator abuts and pulls the slider along a linear path between a fully expanded position and a fully retracted position;

pulling the drawer to the open position, thereby causing the actuator to engage the spring biased slider and place the spring-biased slider in the extended position; and utilizing a spring as the actuator.

19. The method of claim 18, further comprising:

aligning a drawer door by including a plurality of teeth on the slide assembly.

20. The method of claim 18, further comprising:

engaging the plurality of teeth with a rack and pinion gear system.

* * * * *